United States Patent [19]

Fishman

[11] 4,080,810

[45] Mar. 28, 1978

[54] RIMLATCH TO DEADBOLT LOCK CONVERTER ACCESSORY

[76] Inventor: Sherman S. Fishman, P.O. Box 321, San Francisco, Calif. 94101

[21] Appl. No.: 566,772

[22] Filed: Apr. 10, 1975

[51] Int. Cl.[2] ..... E05B 17/00

[52] U.S. Cl. ..... 70/129; 70/418; 70/431; 292/137; 292/346

[58] Field of Search ..... 70/124, 129, 137, 418, 70/416, 461, 463, 464, 431; 292/2, 1, 137, 342, 343, DIG. 56, DIG. 57, 346, DIG. 44, DIG. 54, DIG. 38; 248/205 A

[56] References Cited

U.S. PATENT DOCUMENTS

| | | | |
|---|---|---|---|
| 866,565 | 9/1907 | Bellamy | 292/342 |
| 1,194,636 | 8/1916 | Joy | 292/DIG. 56 |
| 1,431,571 | 10/1922 | Daly | 292/2 |
| 2,125,779 | 8/1938 | Geyer | 292/DIG. 56 |
| 3,190,599 | 6/1965 | Margulis | 248/205 A |

FOREIGN PATENT DOCUMENTS

| | | | |
|---|---|---|---|
| 1,923,974 | 11/1970 | Germany | 292/DIG. 38 |
| 12,386 | 5/1916 | United Kingdom | 292/2 |

*Primary Examiner*—Roy D. Frazier
*Assistant Examiner*—Rodney H. Bonck

[57] ABSTRACT

A formed block of metal, plasic, or other suitable material, shaped to adhesively abutt the bevelled face of the bolt of a springlatch door lock, changing it from prism to rectangular shaped parallelpiped.

6 Claims, 7 Drawing Figures

RIMLATCH TO DEADBOLT LOCK CONVERTER ACCESSORY

BACKGROUND AND SUMMARY OF THE INVENTION

This accessory block of metal, plastic or other suitable material, will convert a mortise lock of the springbolt rimlatch type with a bolt having a flat or domed bevelled face which is self latching when the door is closed, into a deadbolt lock which must be opened and closed with a key. The deadbolt lock is generally regarded as the more secure door lock. The mortise springlatch lock is not secure and can easily be opened from the outside by shimming (loiding) with a credit card or other material such as semi-rigid cellophane. Anti-theft programs recommend that the springlatch door lock be replaced with a deadbolt door lock. This is an expensive and time consuming exchange. It would be desirable to have some way to convert the existing springlatch door lock into a deadbolt type. This invention does that by the use of a five or six sided prismatic block of suitable dimensions and adhesives which have only recently become available. The principle involved is one of removing the bevelled face, for without a bevelled face the shimming technique will not work. The bevelled face is mated to a prism or wedge-type block which can be solid or hollowed and when suitably attached to the springlatch the bevel disappears. Using this technique the springlatch bolt is changed into a deadbolt with a minimum of expense and effort.

DETAILED DESCRIPTION OF THE DRAWINGS

Figure 1:
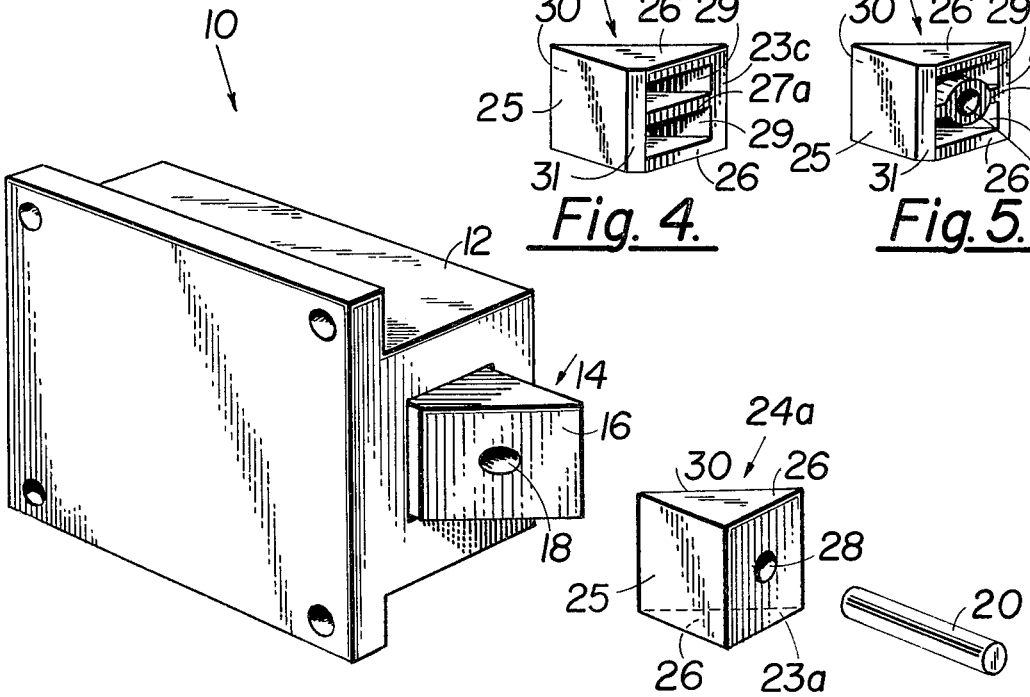
FIG. 1, FIG. 1*a* and FIG. 1*b* are disassembled views of mortise locks of the rim springlatch type with the various embodiments of the accessory block and case hardened steel reinforcing pin.

Referring to FIG. 1 the springlatch mortise lock 10 is shown having a case 12 and a bolt 14 having its face 16 bevelled. The prismatic block 24*a* has a bevelled face 30 which will fit onto the bolt bevelled face 16 when assembled. The dimensions of the bevelled face 30 is in the range of 10 mm to 25 mm × 30 mm. As an additional security measure I have also shown an alternative which may be added very simply. A hole 28 is drilled through the back side 23*a* or partially through the prismatic block 24*a* and parallel to its bases 26. A similar hole 18 is drilled into the bevelled face 16 of the springlatch bolt. A case hardened steel dowel pin 20 can be inserted into the hole 18 and the hole 28 which will further support the position of the prismatic block 24*a* while the adhesive cures. In the event of a burglary if an attempt is made to saw through the bolt 14 and prismatic block 24*a* the hardened steel pin 20 will take much longer to be penetrated. Conceivably sufficiently long to deter the break-in. The pin 20 resists cutting by its hardness and if no adhesive is used on the pin, it will roll instead of being cut. Alternative methods of assembling the prismatic block 24*a* onto the springlatch bolt 14 would be to thread both ends of the pin 20*a* and to also tap and thread the hole 18*a* and hole 28*a*. Thus the threaded pin can be screwed into the bolt leaving a projecting portion onto which the block can be screwed down tight which will complete the assembly without adhesives. Further, the pin 20*b* may also be grooved along its length and adhesive put in the grooves and the pin, block and bolt assembled together with the adhesive supporting the assembly in position. The block 24*a* is shown in the drawing to be solid but it may be hollowed in places to reduce the weight and cost.

Figure 2:
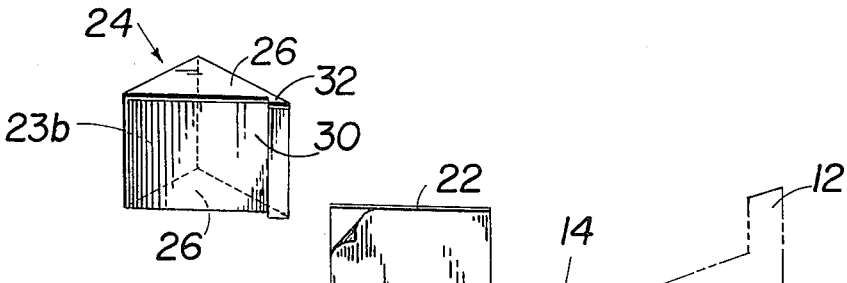
FIG. 2 is a disassembled view of the springlatch bolt, a piece of adhesive and the accessory block.

FIG. 2 shows the springlatch bolt 14 and the bevelled face 16 being flat or domed or convex. The prismatic block 24 with its bevelled face 30 is the mirror image of the bevel 16. These are shown without the security-pin holes. A suitable adhesive such as double faced foam adhesive strip 22 is illustrated as an example of one way to assemble the prismatic block 24 onto the springlatch bolt 14. Other adhesives are readily available and it is necessary to put the adhesive on only one face if a liquid or paste is used. The advantage of the double backed foam adhesive strip method is that it holds both faces in proper position without any cure time being required. For additional security the holes may be drilled and the security-pin inserted as described in FIG. 1. An alternative method of constructing the prismatic block is to undercut the bevelled face 30 to accommodate the adhesive foam 22 in a way that creates an extension 32 equal to the thickness of the adhesive 22, which will then abutt closely to the mating face of the bolt making the bolt and block accessory more perfectly continuous. This is illustrated in FIG. 3 where the overhang 32 is shown to make closer contact with the springlatch bolt and the adhesive does not extend out to the edge.

Figure 3:
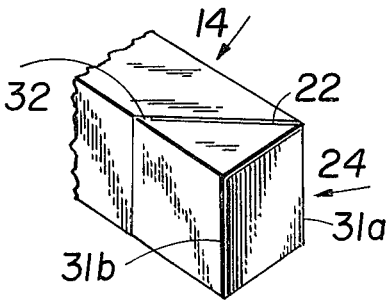
FIG. 3 is an assembled view showing the springlatch bolt and the accessory block.
Figure 1A:
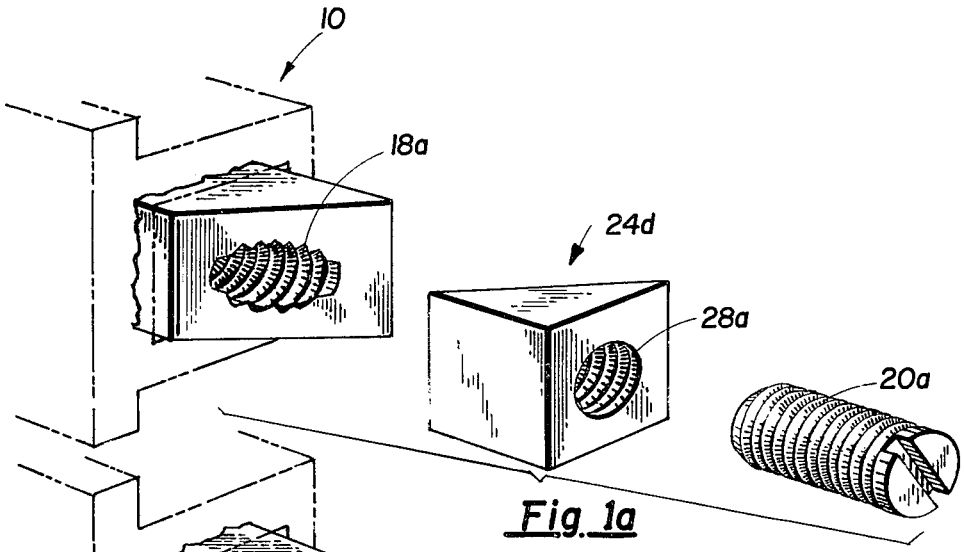
Figure 1B:
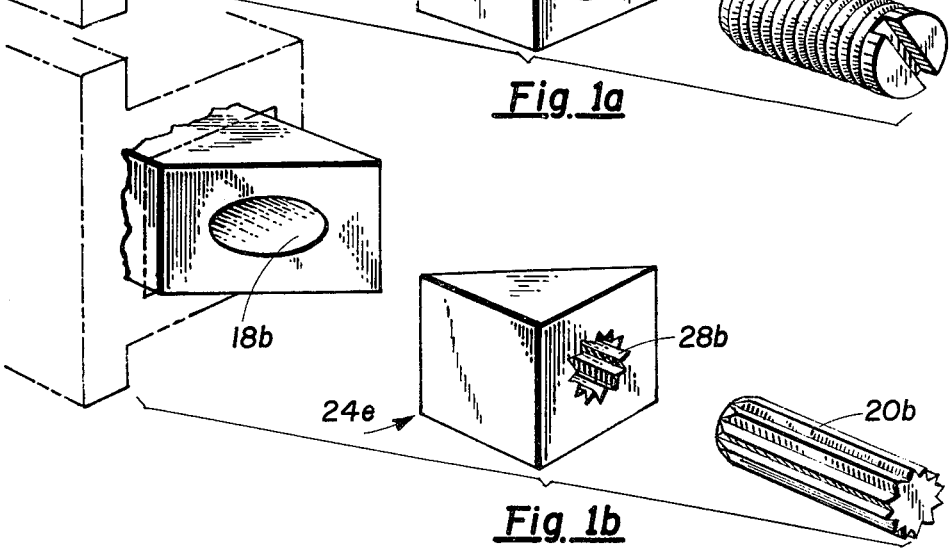

FIG. 3 shows the assembled bolt which now resembles the deadbolt type. It consists of the springlatch bolt portion 14 and the prismatic block 24 held together by the adhesive laminate 22. This bolt is no longer a springlatch type bolt and must be opened with a key and closed with a key. The corners 31*a* and 31*b* may catch on the striker plate in the door frame and it may be helpful to have a slight bevel on one or both of these corners as shown in the corner 31 of FIG. 4. It is resistant to being opened by the cellophane strip commonly used to gain entry through a door that does not have a deadbolt lock. suitable materials for the prismatic block 24 are brass, bronze, aluminum, steel, plastic, molded epoxy and the like. Suitable adhesives are epoxies, acrylic glues, urethane resins, double-faced adhesive foam tape or other methods of attachment such as magnetism or screws into drilled and tapped holes.

Figure 4:
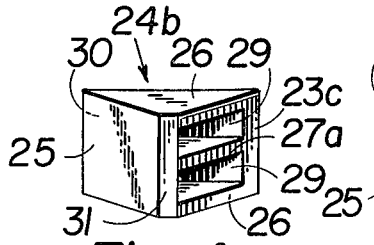
FIG. 4 is a rear view of a hollowed out block with a reinforcing plane in the center.

FIG. 4 is a rear view of the block 24*b* showing the bevelled face 30 and its triangular bases 26 and the side 25 and the rear 23*c*. Hollowed out areas 29 are shown and the reinforcing plane 27*a* provides structural strength of the block. The corner formed by the side 25 meeting the rear 23*c* can be bevelled to provide easy return of the bolt to the door frame. This bevelled corner 31 can be provided by the manufacturer or it can be very simply performed by the installer. If the corner 31 is bevelled then the block becomes a six-sided figure. The thickness of the bases 26 is such that minor changes in dimension can be made by the installer by shaving the surface thereby reducing the thickness to fit the bolt of any particular lock. The wall 25 may be found to be too long and fracture lines may be scribed in the block to facilitate easy cutting or bevelling which will assist in more precise fitting of the block onto the bolt by an installer.

Figure 5:
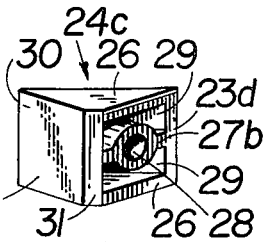
FIG. 5 is a rear view of a hollowed out block with a hole in the reinforcing plane for receiving a dowel pin.

FIG. 5 is a rear view of a hollowed block 24*c* showing the hollowed spaces 29, the bevelled corner 31, and the security-pin hole 28 formed in the reinforcing bar 27*b*.

These and other modifications will be apparent to those skilled in the art of this invention which includes all modifications falling within the scope of the following claims:

I claim:

1. The combination for forming a deadbolt lock comprising a latch having a sliding bolt, said sliding bolt having an end face deposed at an angle to the axis of the bolt and a block in the form of a right prism having bases which are right triangles, the acute angles of which are approximately 45° and means affixed to said prism for securing the face of the prism opposite the right angles of the bases to the end face of the bolt to thereby convert the bolt to one having an end face disposed perpendicularly to the axes of the bolt.

2. The combination defined in claim 1 wherein said securing means consists of a rectangular layer of flexible adhesive material covering said face of the prism block

3. The combination defined in claim 1 wherein the securing means consists of a threaded cylindrical passage through the central portion of the prism block parallel to its bases and a threaded steel cylinder reposing in and extending from said cylindrical passage.

4. The combination defined in claim 1 wherein the securing means consists of a cylindrical passage through the central portion of the prism block parallel to its bases and a grooved steel rod reposing in and extending from said cylindrical passage.

5. The combination defined in claim 1 wherein the sides of the triangular faces of the prism block which form the right angle are from about 10 mm to 20 mm in length.

6. The combination defined in claim 1 wherein the face of the prism block opposite the right angles of its bases is slightly concave.

* * * * *